United States Patent [19]

Rendall

[11] 4,424,112

[45] Jan. 3, 1984

[54] METHOD AND APPARATUS FOR SOLVENT EXTRACTION

[75] Inventor: John S. Rendall, Morgan Hill, Calif.

[73] Assignee: Solv-ex Corporation, Albuquerque, N. Mex.

[21] Appl. No.: 429,251

[22] Filed: Sep. 30, 1982

Related U.S. Application Data

[62] Division of Ser. No. 382,115, May 28, 1982, which is a division of Ser. No. 159,680, Jun. 16, 1980, abandoned.

[51] Int. Cl.[3] ..... C10G 1/04

[52] U.S. Cl. ..... 208/11 LE; 208/8 LE

[58] Field of Search ..... 208/8 LE, 11 LE, 161, 208/162, 188; 210/690, 691, 692, 693, 708, 711, DIG. 5

[56] References Cited

U.S. PATENT DOCUMENTS

| | | | |
|---|---|---|---|
| 2,772,209 | 11/1956 | Stewert et al. | 208/11 LE |
| 2,921,010 | 11/1960 | Sherborne | 208/11 LE |
| 3,527,692 | 9/1970 | Titus | 208/11 LE |
| 3,884,829 | 5/1975 | Moyer | 208/11 LE |
| 3,925,189 | 12/1975 | Wicks | 208/11 LE |
| 4,160,718 | 7/1979 | Rendall | 208/11 LE |
| 4,161,428 | 7/1979 | Gottschlisch et al. | 208/11 LE |
| 4,338,185 | 7/1982 | Noelle | 208/11 LE |
| 4,347,118 | 8/1982 | Funk et al. | 208/11 LE |

FOREIGN PATENT DOCUMENTS

| | | | |
|---|---|---|---|
| 659600 | 6/1977 | U.S.S.R. | 208/11 LE |

*Primary Examiner*—Delbert E. Gantz
*Assistant Examiner*—A. Pal
*Attorney, Agent, or Firm*—Thomas E. Schatzel

[57] ABSTRACT

A method and apparatus for solvent extraction of bitumen oils from tar-sands and their separation into synthetic crude oil and synthetic fuel oil comprising the operations of mixing the tar-sands with hot water so as to form a slurry in conjunction with solvent, separating that slurry into the solvent and dissolved bitumen oils and the solid materials of the tar-sands, separating the bitumen oils from the solvent, contacting the bitumen oils thus obtained with an extractant in order to separating them into synthetic crude oil and synthetic fuel oil, recovering an reusing again within the process the solvent, the water and the extractant.

19 Claims, 5 Drawing Figures

METHOD AND APPARATUS FOR SOLVENT EXTRACTION

This is a division of application Ser. No. 06/382,115, filed May 28, 1982 still pending which is a divisional of Ser. No. 06/159,680, filed June 16, 1980 now abandoned.

BACKGROUND OF THE INVENTION

1. Field of the Invention

This invention relates to a solvent extraction process for removing bitumen oils from tar-sands and includes a process by which the bitumen oils thus extracted are separated into synthetic crude oils and synthetic fuel oil.

More particularly, this invention extracts bitumen oils by forming a heated slurry of tar-sands with water and solvent, separates the bitumen oils, solvent and water from the solid material in that slurry, separates the bitumen oils from the mixture with solvent and water and then further separates the bitumen oils thus obtained into synthetic crude oil and synthetic fuel oil by contacting with a selective extractant.

2. Description of the Prior Art

A commercially viable, ecologically compatible method for extracting bitumen oils from tar-sands has been sought for a number of years. The literature on the extraction of bitumen oils from tar sands is vast, and describes many processes which claim to separate the bitumen oils from the sand and subsequently upgrade these oils into synthetic crude oil. Two major categories of methods for bitumen oil extraction from tar-sands are those which employ hot water to float the bitumen oils away from the tar-sands and those which employ an organic solvent to dissolve the bitumen oils out of the tar-sands.

The hot water method for bitumen oil extraction from tar-sands is only marginally viable commercially. Its deficiencies are a relatively low extraction rate of the bitumen oils contained within the tar-sands containing little or no entrained water, consumption of large quantities of water relative to the amount of bitumen oil extracted from the tar-sands and the need for environmentally unacceptable large tailing ponds in which is deposited an emulsion of bitumen oils, clay and water.

Methods using organic solvents to dissolve the bitumen oils out of the tar-sands, e.g. U.S. Pat. No. 4,160,718 issued to John S. Rendall, have also been attempted. The disadvantages of these processes for the extraction of bitumen oil from tar-sands are the environmentally unacceptable losses of solvent, the environmental hazard posed by the storage of large solvent inventories, the relative large quantity of water required to quench the hot sands after the solvent has been removed and difficulties of scaling up the process, especially the units used to remove solvent from the solid tailings.

SUMMARY OF THE PRESENT INVENTION

An object of the present invention is to provide a method for bitumen oil extraction from tar-sands which is commercially practical.

Another object of the present invention is to provide a method for the extraction of bitumen oils from tar-sands and for the separation of the bitumen oils into synthetic crude oil and synthetic fuel oil in which all the individual units can be easily scaled up.

Another object of the present invention is to provide a method for the extraction of bitumen oils from tar-sands in which a high proportion of the bitumen oils contained in the tar-sands is extracted.

Another object of the present invention is to provide an environmentally acceptable method for the extraction of bitumen oils from tar-sands in which the effluents are basically a damp sand essentially free of bitumen oils and/or solvents, and combustion products with acceptably low sulfur emissions.

Another object of the present invention is to provide a method for the extraction of bitumen oils from tar-sands which does not produce emulsions of fine tar-sand particles, water and bitumen oils with air.

Another object of the present invention is to provide a method for the extraction of bitumen oils from tar-sands which does not require the mechanical pumping of slurries.

Another object of the present invention is to provide a method for the extraction of bitumen oils from tar-sands in which the solvent used is one of the constituents of the bitumen oil contained within the tar-sands, and, in which, that solvent is recovered and reused with all process losses made up from the bitumen oil extracted from the tar-sands.

Another object of the present invention is to provide a method for the extraction of bitumen oils from tar-sands in which a higher fraction of the water employed is recovered and reused.

Another object of the present invention is to provide a method to extract bitumen oils from tar-sands in which the ratio of water consumed to bitumen oils extracted is greatly reduced.

Another object of the present invention is to provide a method for the extraction of bitumen oils from tar-sands which produces a bitumen oil extract containing essentially no free sulphur.

Another object of the present invention is to provide a method for the extraction of bitumen oils from tar-sands in which the heat loss of the process is low.

Another object of the present invention is to provide a new method for the separation of the bitumen oils extracted from the tar-sands into synthetic crude oil and synthetic fuel oil.

Briefly, a preferred embodiment of the method of the present invention comprises the operations of conditioning tar-sands by mixing them with hot water and solvent while excluding substantially all air so as to form a slurry containing sand, clay, bitumen oils, solvent and water. That slurry is separated into a bitumen extract, containing bitumen oils, solvent and water, and a solids extract, containing sand, clay, solvent and water. The bitumen extract is further separated into the bitumen oils, the solvent and the water. The bitumen oils are contacted with an extractant so as to selectively remove certain components of the bitumen oils and then removing that extractant from the two fractions thus separated thereby obtaining synthetic fuel oil and synthetic crude oil. The extractant is recovered and reused to contact the bitumen oils. The solids extract, produced by the separation of the slurry are separated into the bitumen extract and the solids extract, into solvent, water and a damp tailings, containing sand, clay and a low content of water. The water separated from the bitumen extract and the solids extract are recovered and reused to mix with the tar-sands.

A preferred embodiment of the apparatus of the present invention includes a jet mixer to form tar-sands into a slurry containing sand, clay, bitumen, solvent and water. A rotating raining bucket contactor is used in conjunction with a flow of extractant to separate bitumen oils into synthetic crude oil and synthetic fuel oil. A vacuum belt filter is used to remove moisture from solids extract. Also, a rotating raining bucket contactor may be used in conjunction with a flow of solvent and a solvent stripping means to remove bitumen oils from clays contaminated with associated bitumen.

An advantage of the method of the present invention is that a high proportion of the bitumen oils contained in the tar-sands is extracted.

Another advantage of the method and apparatus of the present invention is that the effluents are basically a damp sand essentially free of bitumen oils and/or solvents, and combustion products with acceptably low sulfur emissions.

A further advantage of the apparatus of the present invention is that the final tar-sands ore particle size reduction occurs in the jet mixer thereby conserving energy when processing consolidated ores.

A further advantage of the method of the present invention is that emulsions of fine tar-sand particles, water and bitumen oils with air are greatly reduced.

A further advantage of the method and apparatus of the present invention is that slurries are not mechanically pumped.

A further advantage of the method of the present invention is that solvent is recovered and reused with all process losses made up by extracting solvent from the bitumen oils.

A further advantage of the method of the present invention is that a higher fraction of the water employed is recovered and reused.

A further advantage of the method of the present invention is that the ratio of water consumed to bitumen oils extracted is reduced.

A further advantage of the method of the present invention is that it produces a bitumen oil extract containing essentially no free sulphur.

A further advantage of the method of the present invention is that heat losses are low.

A further advantage of the method and apparatus of the present invention is that synthetic fuel oil and synthetic crude oil can be separated from bitumen oils in a new way.

These and other objects and advantages of the present invention will no doubt become obvious to those of ordinary skill in the art after having read the following detailed description of the preferred embodiments as illustrated in the various drawing figures.

IN THE DRAWING

Figure 1:
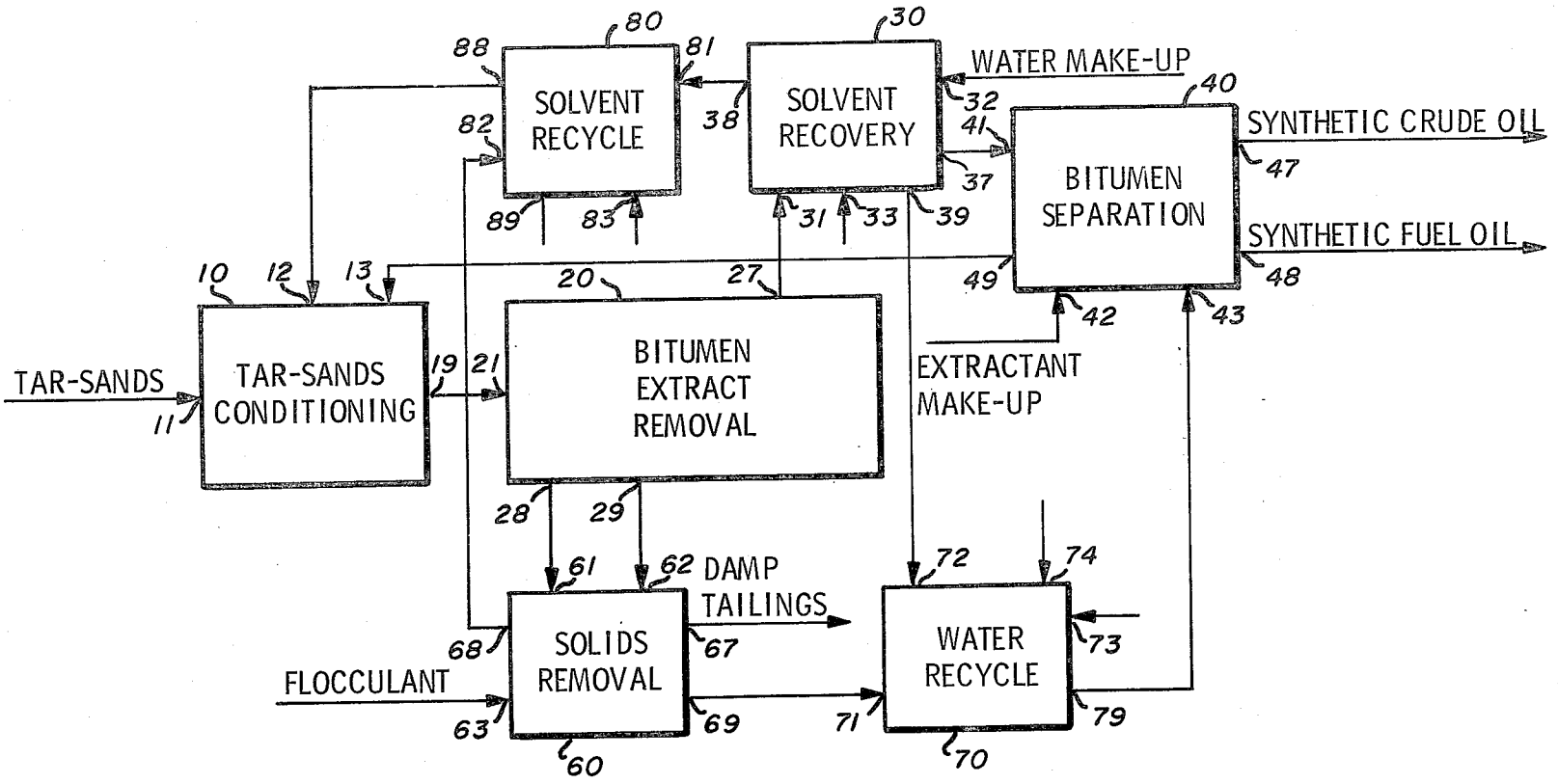
FIG. 1 is an overall block diagram of the method for extracting bitumen oils from tar-sands and separating those bitumen oils into synthetic crude oil and synthetic fuel oil in accordance with the present invention.
Figure 2A:
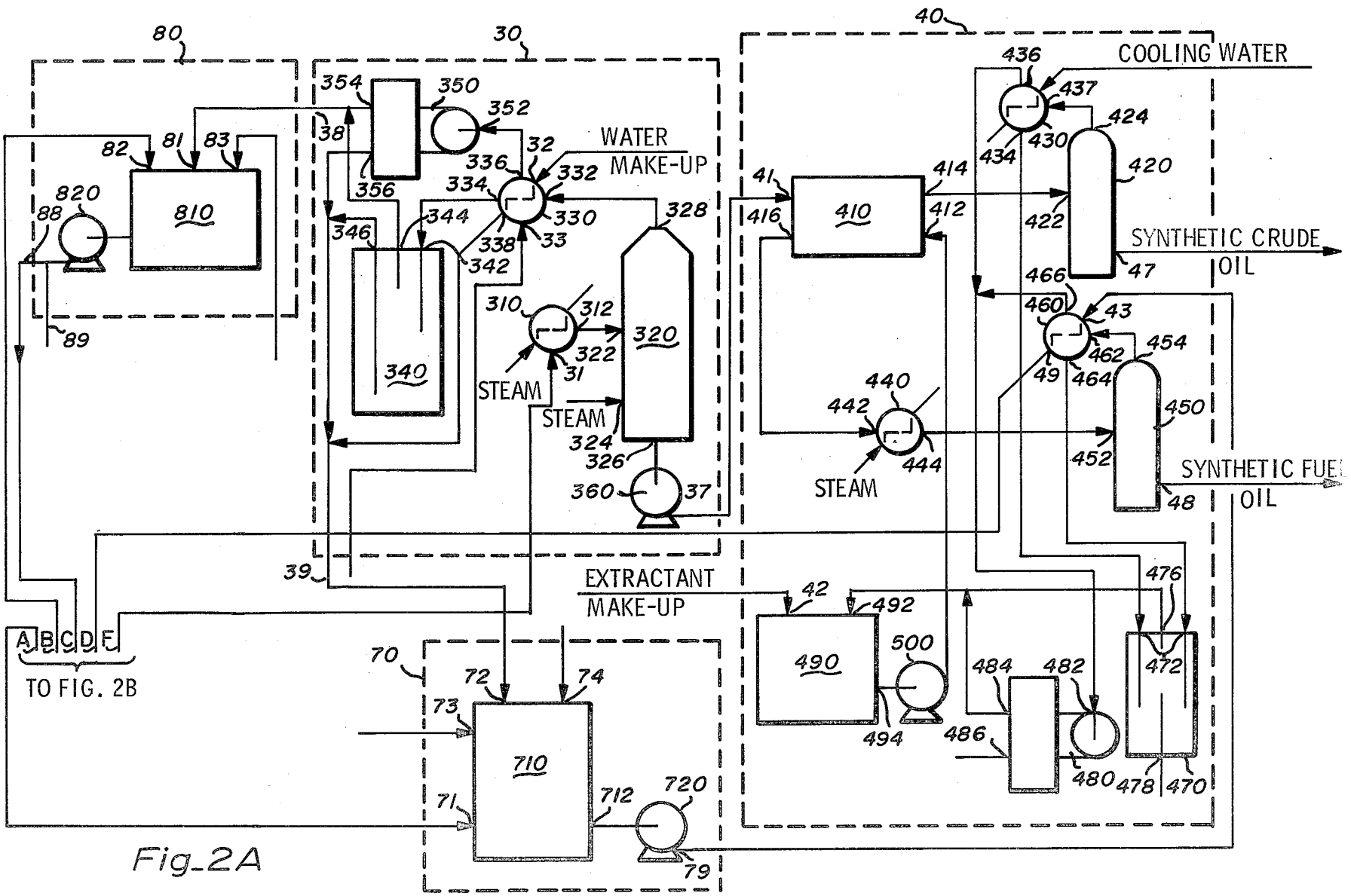
FIG. 2 is a diagram showing a detailed implementation of the process of FIG. 1.
Figure 2B:
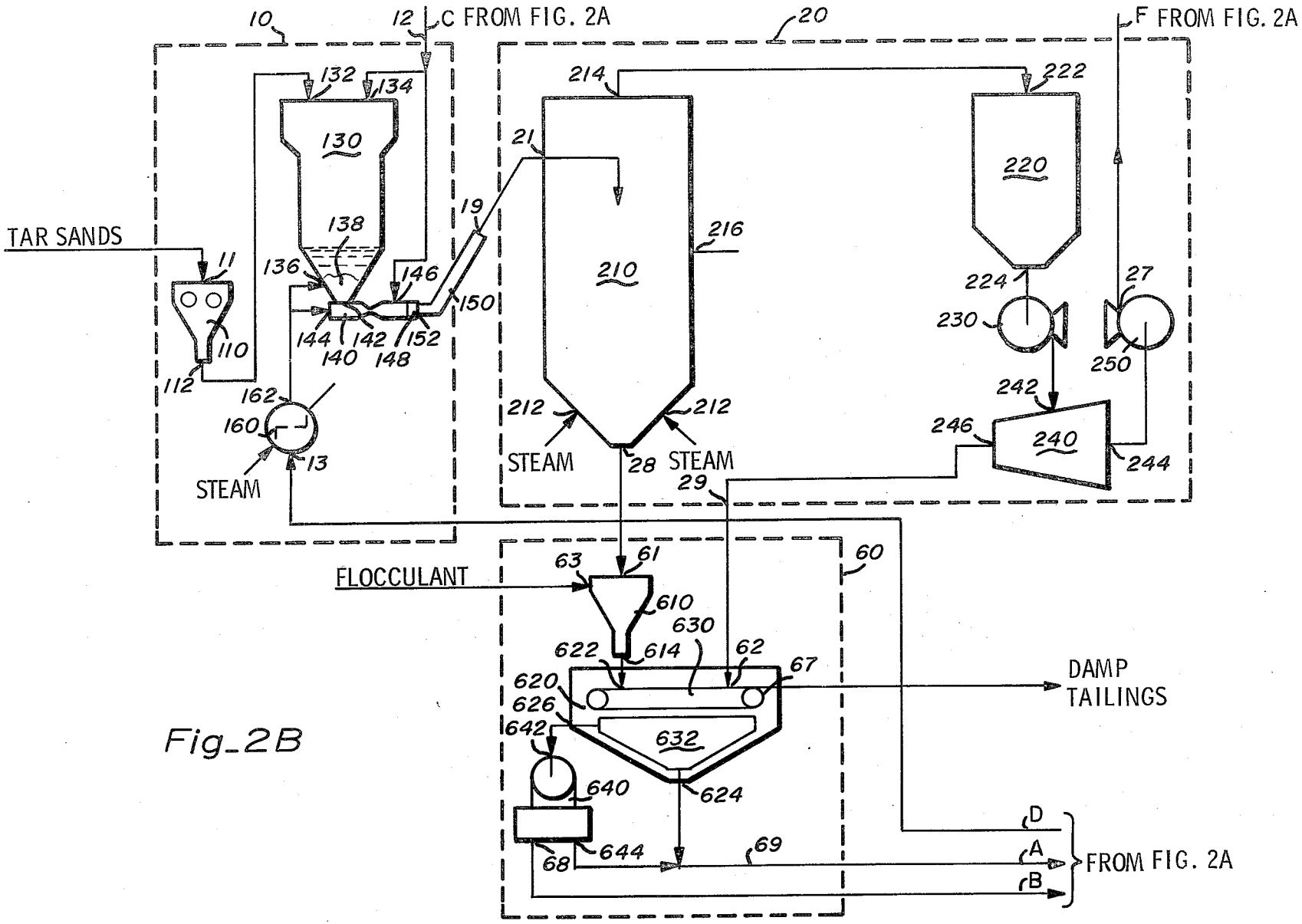
Figure 3:
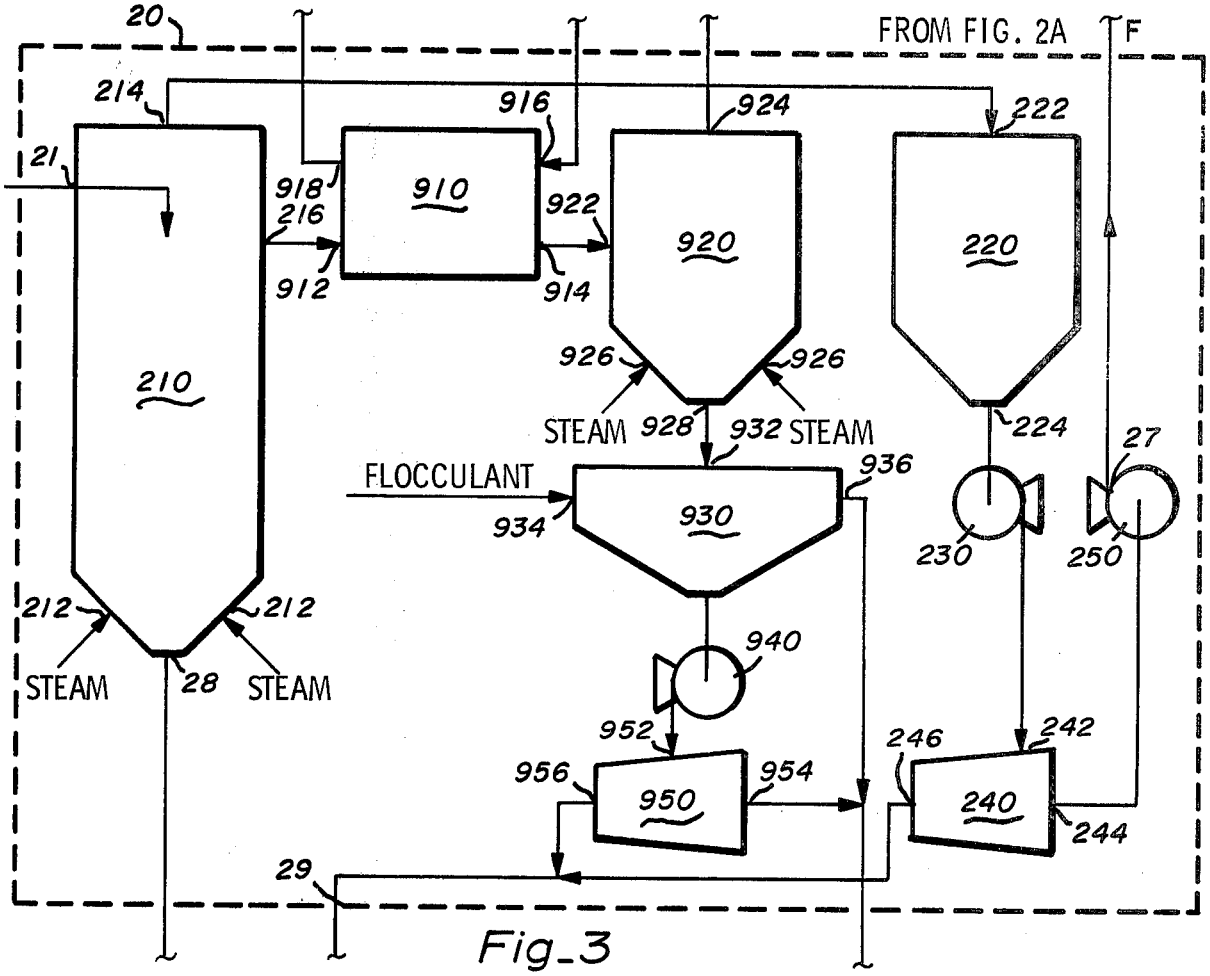
Figure 4:
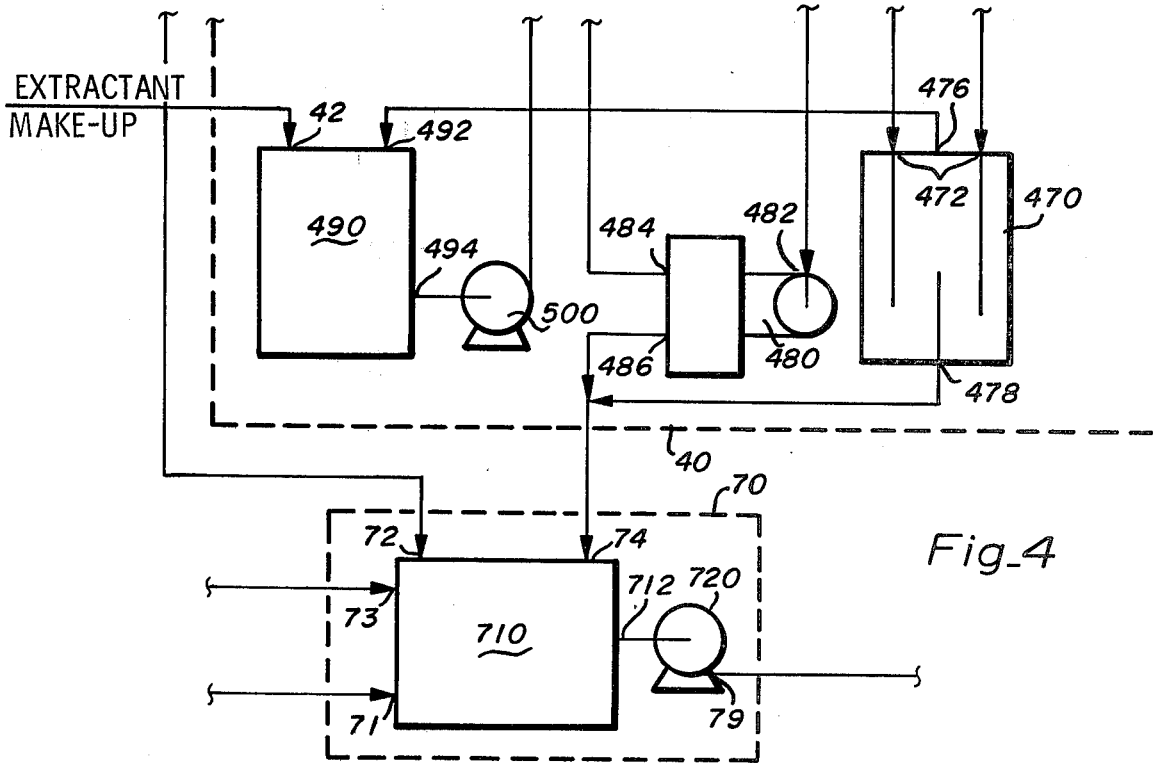

FIG. 3 shows an alternative implementation of the bitumen extract removal means of FIG. 1 especially adapted for tar-sands having extreme clay contamination with associated bitumen; and FIG. 4 is a diagram showing a modification of the detailed diagram of FIG. 2 especially adapted to recover and recycle water from the bitumen separation means. cDETAILED DESCRIPTION OF THE PREFERRED EMBODIMENTS FIG. 1 is a block diagram illustrating the overall process by which bitumen oils are extracted from tar-sands and separated into synthetic crude oil and synthetic fuel oil. The following description of the invention relates to the process as especially adapted to extract bitumen oils from tar-sand ores similar in composition to those found at Santa Rosa, N. Mex.

The process for the extraction of bitumen oils into tar-sands and their separation into synthetic crude oil and synthetic fuel oil begins with the introduction of tar-sands ore, properly prepared when mined, into a tar-sands conditioning means 10, at a tar-sands input point 11. Simultaneously with the introduction of the tar-sands at tar-sands input point 11, solvent is introduced into the tar-sands conditioning means 10 at a solvent input point 12 and water is introduced at a water input point 13. Within the tar-sands conditioning means 10, the introduced tar-sands are crushed and then mixed both with solvent introduced at solvent input point 12 and hot water introduced at water input point 13 to form a slurry, containing sand, clay, bitumen oils, solvent and water, which is essentially free of both unconsolidated pieces of tar-sand and emulsions of fine tar-sand particles, water and bitumen oils with air. The slurry formed by mixing the tar-sands with solvent and hot water leaves the tar-sand conditioning means at a slurry exit point 19.

A bitumen extract removal means 20, accepts a slurry, containing sand, clay, bitumen oils, solvent and water, at a slurry input point 21. The bitumen extract removal means 20 separates that slurry into three mixtures, the first, a bitumen extract, containing bitumen oils, solvent and water with traces of solids, the second, a wet solids extract, containing sand, clay and large quantities of water with traces of solvent, and the third, a damp solids extract, containing sand, clay and a lower quantity of water with traces solvent. The bitumen extract leaves the bitumen extract removal means 20 at a bitumen extract exit point 27, the wet solids extract leaves the bitumen extract removal means 20 at a wet solids extract exit point 28 and the damp solids extract leaves the bitumen extract removal means 20 at a damp solids extract exit point 29.

A solvent recovery means 30, accepts a bitumen extract, containing bitumen oils, solvent and water with traces of solids, at a bitumen extract input point 31 and make-up water at a make-up water input point 32. The solvent recovery means 30 can also accept a secondary flow consisting essentially of a mixture of solvent and water at an auxillary solvent water input point 33. The solvent recovery means 30 separates the bitumen extract into three streams, the first containing bitumen oils, the second containing solvent and the third containing water. If a mixture of solvent and water is supplied to the auxilliary solvent—water input point 33, that mixture is also separated with the resulting solvent and water being respectively combined with the solvent and water separated from the bitumen extract. The bitumen oils leave the solvent recovery means 30 at a bitumen exit point 37, the solvent leaves the solvent recovery means 30 at a solvent exit point 38 and both the recovered water and the make-up water are combined and leave the solvent recovery means at a water exit point 39.

A bitumen separation means 40, accepts bitumen oils at a bitumen input point 41, extractant make-up at an extractant make-up input point 42 and cooling water at cooling water input point 43. The bitumen oils, input to the bitumen separation means 40 at bitumen input point 41, are contacted with the extractant so as to selectively remove certain components in the bitumen oils. A mixture containing extractant plus long chain hydrocarbons. This process separates the bitumen oils into two fractions both of which are mixed with extractant. The removal of the extractant from these two mixtures recovers virtually all of the extractant introduced into the contactor and yields synthetic crude oil and synthetic fuel oil and, in addition, warms the cooling water flowing into the bitumen separation means 40 at cooling water input point 43. The synthetic crude oil thus obtained leaves the bitumen separation means 40 at a synthetic crude oil exit point 47 and the synthetic fuel oil leaves the bitumen separation means 40 at a synthetic fuel oil exit point 48. Within the bitumen separation means 40, the extractant is recovered and reused repeatedly to separate the fractions in the bitumen oils input to the bitumen separation means 40 at bitumen input point 41. The cooling water, warmed by the heat removed in the extractant recovery, flows out of the bitumen separation means 40 at the heated water exit point 49.

A solids removal means 60, accepts both a wet solids extract, containing sand, clay and water with traces of solvent, at a wet solids extract input point 61, and damp solids extract, containing sand, clay and a lesser quantity of water with traces of solvent, at a dry solids extract input point 62 and a flocculant at a flocculant input point 63. The solids removal means 60 combines the flocculant with the wet solids extract and then separates the flocculated wet solids extract and the damp solids extract into three streams, the first a damp tailings, containing sand and clay with a low concentration of water, the second containing solvent, and the third containing water. The damp tailings leave the solids removal means 60 at a damp tailings exit point 67, the solvent leaves the solids removal means 60 at a solvent exit point 68 and the water leaves the solids removal means 60 at a water exit point 69.

A water recycle means 70, accepts water at two water input points 71 and 72. The water recycle means 70 also has a first auxillary water input point 73 and a second auxillary water input point 74. All water flowing into the water recycle means 70 through these water input points is combined and flows out of the water recycling means 70 at a water exit point 79.

A solvent recycle means 80, accepts solvent at two solvent input points 81 and 82. The solvent recycle means 80 also has an auxillary solvent input point 83. All the solvent flowing into the solvent recycle means 80 through these input points is combined. The primary flow of solvent leaving the solvent recycle means 80 is through a solvent exit point 88. However, a secondary flow of solvent can leave the solvent recycle means 80 through an auxillary solvent exit point 89.

A process for extraction of bitumen oils from tar-sands and their separation into synthetic crude oil and synthetic fuel oil from tar-sands is assembled from these processing means as follows. Tar-sands are fed into tar-sands input point 11 of tar-sands conditioning means 10 along with solvent, obtained from solvent exit point 88 of solvent recycle means 80 and fed into the solvent input point 12 of the tar-sands conditioning means 10, and water, obtained from the heated water exit point 49 of the bitumen separation means 40 and fed into the water input point 13 of the tar-sands conditioning means 10. Within the tar-sands conditioning means 10 the tar-sands, solvent and water are formed into a slurry, containing sand, clay, bitumen oils, solvent and water, which is essentially free of both unconsolidated pieces of tar-sand and emulsions of fine tar-sand particles, water and bitumen oils with air. The slurry leaving the tar-sands conditioning means 10 at slurry exit point 19 flows into the slurry input point 21 of the bitumen extract removal means 20. The bitumen extract, separated out of that slurry, leaves the bitumen extract removal means 20 at bitumen extract exit point 27 and flows into the solvent recovery means 30 at bitumen extract input point 31. The bitumen oils, separated out of the bitumen extract, leave the solvent recovery means 30 at bitumen exit point 37 and flow into the bitumen separation means 40 at bitumen input point 41.

The bitumen oils flowing into the bitumen separation means 40 at bitumen input point 41 are contacted with the extractant which selectively removes certain components from the bitumen oils. Recovery of virtually all that extractant from the mixtures of extractant and bitumen oil fractions thus produced yields synthetic crude oil which flows out the synthetic crude oil exit point 47 of the bitumen separation means 40 and synthetic fuel oil which flows out the synthetic fuel oil exit point 48 of the bitumen separation means 40. All losses of extractant in the bitumen separation means 40 are made up by the addition of extractant at the extractant make-up input point 42.

The wet solids extract, leaving the bitumen extract removal means 20 at the wet solids extract exit point 28, pass to the solids removal means 60 at the wet solids extract input point 61. Similarly the damp solids extract, leaving the bitumen extract removal means 20 at damp solids extract exit point 29 pass to the solids removal means 60 at the damp solids extract input point 62. The flocculant, input to the solids removal means 60 at the flocculant input point 63, and the wet solids extract are combined within the solids removal means 60. The moisture content of both the flocculated wet solids extract and the damp solids extract is reduced by a vacuum belt filter thereby yielding damp tailings, which leave the solids removal means 60 at the damp tailings exit point 67. The moisture thus removed is separated into the solvent, which leaves the solids removal means 60 at the solvent exit point 68, and water which leaves the solids removal means 60 at the water exit point 69.

The combined flows of recovered water and make-up water leaving the solvent recovery means 60 at the water exit point 39 flow into the water recycle means 70 at water input 72. Similarly, water leaving the solids removal means 60 at the water exit point 69 flows into the water recycle means 70 at the water input point 71. All flows of water are combined within the water recycle means 70 and then leave the water recycle means 70 by the water exit point 79 and flow to the cooling water input point 43 of the bitumen separation means 40. Within the bitumen separation means 40 this water is warmed by heat removed in the extractant recovery porcess. It then flows out of the bitumen separation means 40 at the heated water exit point 49 to the water input point 13 of the tar-sands conditioning means 10.

The solvent leaving the solvent recovery means 30 at the solvent exit point 38 flows into the solvent recycle means 80 at solvent input point 81 and the solvent leaving the solids removal means 60 at the solvent exit point 68 flows into the solvent recycle means 80 at the solvent input point 82. These two flows of solvent, combined within the solvent recycle means 80, leave the solvent recycle means 80 at the solvent exit point 88 and flow to the solvent input point 12 of the tar-sands conditioning means 10.

Effective operation of the first three means of this process for the extraction of bitumen oils from tar-sands, i.e., the tar-sands conditioning means 10, the bitumen extract removal means 20 and the solvent recovery means 30 depend upon the solvent selected to extract the bitumen oils from the tar-sands. The solvent chosen to extract the bitumen oils should not inhibit the formation of the slurry formed in the tar-sands conditioning means 10. The solvent chosen should also not inhibit the separation of the bitumen extract in the bitumen extract removal means 20. Lastly, the solvent chosen should be readily separable from the bitumen extract in the solvent recovery means 30. Effective operation of both the bitumen extract removal means 20 and the solvent recovery means 30 is more dependent upon the solvent chosen than is the effective operation of the tar-sands conditioning means 10 because it is generally possible to form the required slurry with any solvent compatible with the requirements of the second and third means.

Separation of the bitumen extract from the other components of the slurry in the bitumen extract removal means 20 can be easily performed for any bitumen extract having a specific gravity less than 1.0. However, bitumen extracts having a lower specific gravities are more easily separated than those having greater specific gravities because of the relatively higher buoyancy of bitumen extracts with lower specific gravities. Thus, almost any light hydrocarbon with a specific gravity less than 0.9 applied to the crushed tar-sands will produce a bitumen extract capable of being separated in the bitumen extract removal means 20. However, bitumen extract separation is especially facilitated if the specific gravity of the bitumen extract is no greater than 0.9.

Separation of the solvent from the bitumen extract in the solvent recovery means 30 can be performed for a wide range of light hydrocarbons having a specific gravity less than 0.9. However, solvent recycling will be facilitated if the solvent chosen is one of the constitutents of the bitumen oils extracted from the tar-sands. Because of the generally complex chemical composition of bitumen oils extracted from tar-sands, there may be more than one potential solvent contained in the bitumen oils. In such a case, the solvent chosen should be the bitumen oils extract component most easily separated from the bitumen oils in combination with the water also present in the bitumen extract provided that there is a sufficient concentration of that material in the native bitumen to easily make up the solvent losses of the process. By choosing such a solvent for bitumen oils extraction, the solvent inventory required to extract bitumen oils from tar-sands can be maintained by merely extracting the necessary make up solvent in combination with water from the bitumen extract and then separating the mixture of solvent and water thus obtained.

Applying these three criteria for the selection of a solvent to be employed to extract bitumen oils from tar-sands, i.e. having a specific gravity less than 0.9, being a significant component in the bitumen oils contained in the tar-sands being processed and ease of separation of a mixture of solvent and water from the bitumen oils, to tar-sands similar in composition to those extracted at Santa Rosa, N. Mex., makes toluene the preferred hydrocarbon to use as the solvent to use for bitumen oil extraction. Toluene has a specific gravity of approximately 0.866 at 60° F., reducing as the temperature increases, it is a component in the native bitumen oils of Santa Rosa Ores and it forms an azeotrope with water and thus can be easily separated from the bitumen oils.

Once the slurry containing sand, clay, bitumen oils, solvent and water has been formed within the tar-sands conditioning means 10, the preferred method of operating the process is to maintain the temperature of the material containing the bitumen oils (i.e. the slurry within the tar-sands conditioning means 10 and flowing out the slurry exit point 19 and into the slurry input point 21 of the bitumen extract removal means 20, and the bitumen extract within the bitumen extract removal means 20 and flowing out of the bitumen exit point 27 and into the bitumen input point 31 of the solvent recovery means 30) at as high a temperature as possible in order to expedite the extraction of the bitumen oils from the tar-sands but not at so high a temperature as to cause the solvent to separate from the mixture containing the bitumen oils. If toluene is used as the solvent, then the temperature of the mixture containing the bitumen oils should be kept just below the temperature at which the azeotrope of toluene and water will enter the gaseous phase, i.e. approximately 180° F.

Just as there is a choice among potential solvents used to extract the bitumen oils depending upon the chemical composition of the tar-sands, there are several possible locations within the first two means of this process at which the solvent can be mixed with the tar-sands. The choice of location at which to introduce the solvent is critically dependent upon whether the tar-sands are water-wet or bitumen-wet and the properties of the bitumen oils. The difference between these two classifications of tar-sands is that the solid particles which are the nucleus of water-wet tar-sands are surrounded by a layer of water which is in turn enclosed by the layer of bitumen oils whereas bitumen-wet tar-sands lack the water layer between the nucleus and the bitumen oils. The tar-sands found at Santa Rosa, N. Mex. are bitumen-wet which necessitates soaking the ore in solvent prior to forming the slurry with hot water in the tar-sands conditioning means 10. This pre-soaking with solvent is necessary in order to soften the bitumen oils contained in Santa Rosa, N. Mex. tar-sands so that they will disengage from the nuclei in the heated slurry. Alternatively, if water-wet tar-sands are to be processed, pre-soaking the tar-sands with solvent prior to slurry formation can be omitted. Thus, in processing water-wet ores the solvent need be introduced into the mixture of hot water and tar-sands only to establish the preferred specific gravity desired for bitumen extract separation. Therefore, in processing such ores the introduction of solvent need be made only immediately prior to the final removal of solid materials from the bitumen extract in the bitumen extract removal means 30.

A detailed implementation of the tar-sand conditioning means 10 of FIG. 1 is shown within dashed line 10 of FIG. 2. The processing elements employed in this method of implementing the tar-sand conditioning means 10 include a crushing means 110, having the tar-sands input point 11 and a crushed ore outlet 112. The crushing means 110 acts upon the tar-sands fed into it at tar-sands input point 11 so as to assure that the diameter of the ore particles leaving the crushed ore exit 112 does not exceed a specified diameter. The crushed ore is loaded into a soak/feed hopper 130, having a tar-sands input 132, a solvent input 134, and a hot water inlet 136. The hopper includes an outlet 138 through which a mixture of solvent soaked tar-sands and hot water leaves the soak/feed hopper 130. In operation the crushed tar-sands are loaded and first soaked with solvent and then subsequently exposed to hot water so as to exclude substantially all air from the flow of solvent soaked tar-sands and hot water which exit the soak/feed hopper 130 at its outlet 138 to a jet mixer 140. The mixer 140 has an inlet 142 into which flow the solvent soaked tar-sands and hot water in such a manner so as to exclude all air, a hot water inlet 144, an auxillary solvent inlet 146 and a slurry outlet 148 operated so as to pulverize the solvent soaked tar-sands, to form a slurry consisting essentially of sand, clay, bitumen oils, solvent and water, and to eject that slurry from the slurry outlet 148.

The outlet 148 is joined to a pipe 150 having a slurry inlet 152 at one terminal end and the slurry exit point 19 of the tar-sand conditioning means 10 at the other terminal end. The cross-section of the pipe 150 is chosen such that a turbulent flow will exist in the slurry flowing through the pipe 150 thereby maintaining the solid material of the slurry in suspension. The length of the pipe 150 is chosen such that the duration of the slurry condition is maintained long enough to allow substantially complete separation of the bitumen oils from the tar-sands.

The conditioning means 10 further includes a heat exchanger 160, having the water input point 13 and an outlet 162, in which water is heated.

The method of operation of this implementation of the tar-sand conditioning means 10 is as follows. Tar-sand, appropriately prepared at the time of mining, is fed into the crusher 110 which acts so as to assure that none of the ore particles fed into the soak/feed hopper 130 exceeds a specified diameter. It is important that the maximum ore particle diameter does not exceed this predetermined limit. This diameter may be in the order of one quarter to one half inch but in any case smaller than the diameter of the jet nozzel. The tar-sands leaving the crusher 110 at the crushed ore outlet 112 are fed into the soak/feed hopper 130 at the tar-sand input 132. Once the crushed tar-sand has entered the soak/feed hopper 130 it is soaked with a solvent which flows into the soak/feed hopper 130 at the solvent input point 134. As the solvent soaked tar-sands nears the bottom of the soak/feed hopper 130 it passes through a layer of hot water injected into the soak/feed hopper 130 through the hot water inlet 136. After substantially all air has been eliminated from the solvent soaked tar-sands by passing through the layer of hot water in the bottom of the soak/feed hopper 130, the mixture of solvent soaked tar-sands and hot water exits the soak/feed hopper 130 at outlet 138.

The solvent soaked tar-sands and hot water leaving the soak/feed hopper 130 through outlet 138 enter immediately into the jet mixture 140 through the inlet 42. Concurrently with the flow of solvent soaked tar-sands and hot water into jet mixer 140 through the inlet 142, hot water is also injected into the jet mixer 140 at hot water inlet 144. The flows of solvent soaked tar-sands entering the jet mixer 140 at the inlet 142 and the hot water entering the jet mixer 140 at the hot water inlet 144 are adjusted such that the pressure drop across the jet is sufficient to pulverize any rocks in the solvent soaked tar-sands and that the total quantity of water entering the jet mixer 140 both mixed with the solvent soaked tar-sands at the inlet 142 and injected at the hot water inlet 144 is between one and two times the weight of the tar-sand being fed into the jet mixer 140. The amount of force used to pulverize the tar-sands is determined by the pressure drop across the jet mixer 140 from its hot water inlet 144 to its slurry outlet 148.

The slurry consisting essentially of sand, clay, bitumen oils, solvent and water, which leaves the jet mixer 140 at the slurry outlet 148, immediately enters the slurry inlet 152 of pipe 150. The cross-section of pipe 150 is chosen such that the flow of slurry through the pipe will be turbulent. The turbulent flow of the slurry ensures that the solid particles which it contains will not settle out. By maintaining these slurry conditions while the slurry flows through the pipe 150, the solvent and hot water, also contained in the flowing slurry, are permitted to continue extracting the bitumen oils from the solid particles in the slurry. The length of the pipe 150 is chosen such that as the mixture passes through slurry exit point 19 of the tar-sand conditioning means 10, essentially all the bitumen oils have been extracted from the solid particles in the slurry. The maintenance of the slurry condition in the pipe 150 until virtually all the bitumen oils are removed from the solid particles of tar-sands is one of the principal ways in which a high proportion of the bitumen oil contained in the tar-sands is extracted and cooperates in preventing the production of emulsions of fine tar-sand particles, water and bitumen oils with air.

Because substantially all air is excluded from the solvent soaked tar-sands from the point in the process at which both the solvent soaked tar-sands and hot water exit the soak/feed hopper 130 through the outlet 138 to the point in this process at which the slurry exits both the pipe 150 and the tar-sands conditioning means 10 at the slurry exit point 19, the formation of emulsions of fine tar-sand particles, water and bitumen with air is greatly reduced or entirely eliminated.

The water used both to soak a solvent soaked tar-sands in the soak/feed hopper 130 and injected into the jet mixer 140 is heated in the heat exchanger 160 only during process start-up. The heat is obtained by concurrently passing condensing steam through the heat exchanger 160. The tempera-ture of the water is made as high as possible but not so high as to drive off the solvent used to soak the tar-sands in the soak/feed hopper 130.

The mechanical properties of the tar-sand ore and the affinity of that ore for the solvent used to extract the bitumen oils significantly affect the successful operation of this implementation of the tar-sand conditioning means 10 by creating a trade-off among the solvent used to soak the ore particles, the maximum size of the ore particles being fed into the soak/feed hopper 130 and the duration of time for which those ore particles are exposed to that solvent prior to entering the hot water layer in the bottom of the soak/feed hopper 130. Having already selected toluene as the solvent material used to extract the bitumen oils from the ore particles from tar-sand having a composition similar to that found at Santa Rosa, N. Mex., this trade-off is reduced to one between the maximum size of the ore particles being fed into the soak/feed hopper 130 and the duration of time for which those ore particles are exposed to the solvent in the soak/feed hopper 130 prior to entering the hot water layer. While optimum values for these two parameters of the process may never be known since they are intimately connected with the mechanical properties, e.g. the porosity, of the ore which may vary significantly within a single ore body, operation of this implementation of the tar-sand conditioning means 10 can be obtained if the Santa Rosa, N. Mex. tar-sand ore is crushed so that no particle fed into the soak/feed 130 exceeds ½ inch in diameter and the ore particles are soaked in toluene for ½ hour. This combination of solvent, maximum ore particle size and duration of solvent soak when applied to tar-sands extracted from the Santa Rosa, N. Mex. assures that the bitumen oils in the crushed tar-sand ore will be softened prior to entering the hot water layer at the bottom of the soak/feed hopper 130.

As pointed out previously, the choice of solvent establishes an upper limit on the temperature of the solvent soaked tar-sands while they are being soaked in hot water to remove essentially all air in the soak/feed hopper 130 and on the temperature of the slurry formed in the jet mixer 140. The use of toluene as the solvent establishes an upper limit on those temperatures of approximately 180° F. In order to obtain this temperature at the slurry outlet 148 of the jet mixer 140, the temperature of the hot water entering both the soak/feed hopper 130 through the hot water inlet 136 and the jet mixer 140 through the hot water inlet 144 is approximately 200° F.

As also pointed out previously the relative concentration of solvent in the slurry exiting the tar-sands conditioning means 10 at the slurry exit point 19 must be controlled so as to provide a bitumen extract having the preferred specific gravity less than 0.9 at the bitumen extract exit point 27 of the bitumen extract removal means 20. Passing the solvent soaked tar-sands through the layer of hot water at the bottom of the soak/feed hopper 130 has a tendency to drive off the solvent and it is possible that, for some combinations tar-sand ore and solvent, the solvent soaked tar-sands will not retain sufficient solvent at the inlet 142 of the jet mixer 140 to establish the preferred specific gravity for the bitumen extract. If such ores are processed, the relative concentration of solvent in the slurry required to obtain the preferred specific gravity of the bitumen extract is established by the injection of additional solvent directly into the jet mixer 140 through the auxillary solvent inlet 146. Both the solvent used to soak the tar-sands in the soak/feed hopper 130 and the additional solvent injected directly into the jet mixer 140, if any, are obtained from the solvent input point 12 of the tar-sand conditioning means 10.

A detailed implementation the bitumen extract removal means 20 of FIG. 1 is shown within the dashed line 20 of FIG. 2. The processing elements employed in this method of implementing the bitumen extract removal means 20 include a bitumen extract separator 210, having the slurry input point 21 of the bitumen extract removal means 20 through which a slurry containing sand, clay, bitumen, solvent and water enters the bitumen extract separator 210. The separator further includes a steam sparging means 212 located near its base, a bitumen extract outlet 214 located near the top of the extract separator 210, a middlings stream outlet 216 located near the middle of the bitumen extract separator 210. The wet solids extract exit point 28 of the bitumen extract removal means 20 is located below the steam sparging means 212 near the base of the extract separator 210. The slurry separates into two streams at the exit point 28 with one being bitumen extract containing bitumen oils, solvent and water with traces of solids and the other being a wet solids extract containing sand, clay and water with traces of solvent. and from which can also be drawn off a middlings stream containing clay, bitumen, solvent and water. The bitumen extract removal means further includes a bitumen extract hold/feed tank 220 having a bitumen extract inlet 222 and a bitumen extract outlet 224, which is used to store the bitumen extract. A pump 230 is connected to the outlet 224 and to a solid bowl centrifuge 240, having a bitumen extract inlet 242, a bitumen extract outlet 244 and a damp solids extract outlet 246, in which the solids content of the bitumen extract is further reduced. A pump 250 having the bitumen extract exit point 27 of the bitumen extract removal means 20 is connected to the outlet 244.

The method of operation of this implementation of the bitumen extract removal means 20 is as follows. The slurry containing sand, clay, bitumen, solvent and water exiting the pipe 150 at slurry exit point 19, flows into the slurry entry point 21 of the bitumen extract removal means 20 and extract separator 210. The bitumen extract separator 210 has an enlarged diameter at the top permitting the slurry to separate, under the force of gravity, into the bitumen extract, containing bitumen oils, solvent and water with traces of solids, and the wet solids extract, containing sand, clay and water with traces of solvent. As the solids descend through the extract separator 210 and near the bottom of bitumen extract separator 210 they are sparged with steam by the steam sparging means 212. This reduces the content of entrained solvent in the solids and, in addition raises their temperature. If toluene has been used as the solvent to soak the tar-sands and the temperature of the solids is raised to 180° F. or higher by the steam sparge, any entrained toluene is driven out as an azeotrope with water. This steam sparge also acts so as to increase the velocity of bitumen extract droplets rising toward the top of the bitumen extract separator 210. These combined effects of the steam sparge cooperate so as to cause almost complete extraction of toluene and the toluene soluable bitumen components from the solid materials in the tar-sands ore thereby completing the extraction of a high proportion of the bitumen oils in the tar-sands. After having been sparged with steam at the steam sparging means 212 of the extract separator 210, the solids now containing only sand, clay and water with traces of bitumen oils and solvent flow out of the wet solids extract exit point 28 of the bitumen extract removal means 20 and the extract separator 210. In the preferred embodiment of this process for the extraction of bitumen oils from tar-sands especially adapted to process ore similar in composition to those founded at Santa Rosa, N. Mex., nothing flows out of the extract separator 210 through the middlings stream outlet 216.

The bitumen extract containing bitumen, solvent and water with traces of solids, which has risen to the top of the extract separator 210, flows out the bitumen extract outlet 214 and into the bitumen extract inlet 222 of the bitumen extract hold/feed tank 220. The bitumen extract in the bitumen extract hold/feed tank 220 leaves that tank by the bitumen extract outlet 224 and flows to the pump 230 and, after passing through pump 230, to the bitumen extract inlet 242 of solid bowl centrifuge 240. The bitumen extract flowing into the solid bowl centrifuge 240 through the bitumen extract inlet 242 has a radial force applied to it in the solid bowl centrifuge 240 causing the concentration of solid particles in the bitumen extract at the center of the solid bowl centrifuge 240 to be reduced while at the same time increasing the concentration of the solid particles in the damp solids extract as its periphery. The damp solids extract thus produced leaves the solid bowl centrifuge 240 through the damp solids outlet 246 and then leaves the bitumen extract removal means 20 throuh the damp solids exit point 29. The bitumen extract, which has now had its concentration of solids further reduced and which contains almost all of the solvent and water which entered the solid bow centrifuge 240 in the bitumen extract, flows out of the solid bowl centrifuge 240 at the bitumen extract outlet 244. This bitumen extract then flows through the pump 250 and out of the bitumen extract removal means 20 at the bitumen extract exit point 27.

A detailed implementation of the solvent recovery means 30 of FIG. 1 is shown within the dashed line 30 of FIG. 2. The processing elements employed in this method of implementing the solvent recovery means 30 include a heat exchanger 310, having the bitumen extract input point 31 of the solvent recovery means 30 and a heated bitumen extract outlet 312, through which the bitumen extract, containing bitumen oils, solvent and water with traces of clay, flows and is heated. A solvent recovery column 320, having a bitumen extract inlet 322, a steam sparging means 324 located below the bitumen extract inlet 322, a bitumen outlet 326 located near the base of the solvent recovery column 320, and a solvent-water outlet 328 located near the top of the solvent recovery column 320, in which the solvent and water are flashed off the bitumen extract as it enters the solvent recovery column 320 at the bitumen inlet 322 and the steam sparge 324 removes additional solvent from the bitumen oils. solvent-water condenser 330, having a solvent-water inlet 332, the auxillary solvent-water input point 33 of the solvent recovery means 30, a solvent-water outlet 334, a vacuum outlet 336, the make-up water input 32 of the solvent recovery means 30 and a heated water outlet 338 in which the solvent and water are cooled and make-up water is heated. A solvent water separator 340, having a solvent-water inlet 342, a solvent outlet 344 and a water outlet 346, in which the solvent and water separates into streams of solvent and water is joined to the condensor 330. Vacuum is applied to both the solvent-water condensor 330 and the solvent recovery column 320 by a water ring vacuum pump 350 with integral solvent water separator, having a vacuum inlet 352, a solvent outlet 354, and a water outlet 356. A pump 260 having the bitumen exit point 37 of the solvent recovery means 30 is connected to the bitumen outlet 326 of the solvent recovery column 320.

The method of operation of this implementation of the solvent recovery means 30 is as follows. Bitumen extract, containing bitumen oils, solvent and water, leaving the bitumen extract removal means 20 at bitumen extract exit point 27, flows to the bitumen extract input point 31 of the solvent recovery means 30 and the heat exchanger 310. The bitumen extract entering the heat exchanger 310 through bitumen extract input point 31 is heated by a concurrent flow of condensing pressurized steam to or above the temperature at which the solvent and water will become gaseous under the condition of vacuum present in the solvent recovery column 320. If the solvent used to soak the tar-sands in the soak/feed hopper 130 was toluene, the temperature of the bitumen extract leaving the heat exchanger 310 at the heated bitumen extract outlet 312 is 375° F. or higher. The heated bitumen extract leaving the heat exchanger 310 through the heated bitumen extract outlet 312 enters the solvent recovery column 320 through the bitumen extract inlet 322. Upon entering the solvent recovery column 320 the gaseous mixture of solvent and water flashes off the heated bitumen extract under the influence of the vacuum maintained in the solvent recovery column 320 by the water ring vacuum pump 350. As the bitumen oils from which the solvent and water has flashed off descend through the solvent recovery column 320 they are exposed to a steam sparge 324 which removes additional solvent. The bitumen oils remaining in the solvent recovery column 320, after the solvent water azeotrope has flashed off and after the additional solvent has been removed by the steam sparge 324, leave the solvent recovery column 320 by bitumen outlet 326 and flows to pump 360, whose outlet is the bitumen exit point 37 of the solvent recovery means 30.

The gaseous mixture of solvent and water flashed off of the heated bitumen extract upon entry to the solvent recovery column 320 through bitumen extract inlet 322 and the additional solvent, obtained by sparging the bitumen oils with the steam sparging means 324, leave the solvent recovery column 320 through solvent-water outlet 328. The mixture of solvent and water leaving the solvent recovery column 320 by solvent-water outlet 328 enter the solvent-water condenser 330 at the solvent-water inlet 332 where it is cooled to a temperature at which it returns to the liquid phase. If a mixture of solvent and water also flows into the solvent-water condenser 330 through the auxillary solvent water input point 33 of the solvent recovery means 30, it too is cooled to the same temperature. However, in the preferred embodiment of this process for extraction of bitumen oils from tar-sands especially adapted to process ore similar in composition to those found at Santa Rosa, N. Mex., no flow of a mixture of solvent and water is provided to the auxillary solvent water input point 33. The cooled mixture of water and solvent leaving the solvent-water condenser 330 through the solvent-water outlet 334 condenses to the liquid phase prior to flowing into the solvent-water separator 340 at the solvent-water inlet 342. Within the solvent-water separator 340, the solvent and water separate with the solvent leaving the solvent-water separator 340 by the solvent outlet 344 while the water leaves the solvent-water separator 340 by the water outlet 346. Similarly, due to is construction and the manner in which it is operated, solvent leaves the water ring vacuum pump 350 by means of solvent outlet 354 while water leaves the water ring vacuum pump 350 by water outlet 356.

The solvent leaving the solvent water separator 340 by the solvent outlet 344 is combined with the solvent leaving the water ring vacuum pump 350 at solvent outlet 354 to produce the solvent stream which leaves the solvent recovery means 30 at solvent exit point 38. The heated make-up water leaving the solvent water condenser 330 at the heated water outlet 338, the water leaving the solvent water separator 340 at water outlet 346 and the water leaving the water ring vacuum pump 350 at water outlet 356 are combined to produce the water stream which leaves the solvent recovery means 30 at water exit point 39. The use of the make-up water as the coolant for the solvent-water condenser 330, in addition to cooling the mixture of solvent and water flowing through it, also conserves a significant quantity of heat which otherwise woudl have to be supplied to the make-up water in some other way.

A detailed implementation of the bitumen separation means 40 of FIG. 1. is shown within the dashed line 40 of FIG. 2. The processing elements employed in this method of implementing the bitumen separation means 40 includes an extraction contactor 410, having the bitumen input point 41 of the bitumen separation means 40. The extraction contactor 410 further includes an extractant inlet 412, a synthetic crude oil fraction outlet 414 and a synthetic fuel fraction outlet 416. Within the extraction contactor 410 the components of the bituman oils are selectively removed by a suitable extractant, through the action of the rotary contactor and the buckets attached thereto, reference should be made to U.S. Pat. No. 4,160,718. The bitumen separation means 40 also includes a synthetic crude oil stripping column 420, having a synthetic crude oil fraction inlet 422, the synthetic crude oil exit point 47 of the bitumen separation means 40 and an extractant outlet 424, in which synthetic crude oil is produced by removing substantially all traces of the extractant from the synthetic crude oil fraction. An extractant condenser 430, having an asphaltenes extractant inlet 432, an extractant outlet 434, and a vacuum outlet 436, in which gaseous extractant is cooled is attached to the extractant outlet 424 of the synthetic fuel oil stripping column 420. A heat exchanger 440 having a synthetic fuel oil fraction inlet 442 and a synthetic fuel oil outlet 444, through which the synthetic fuel oil fraction flows and is heated is connected to the synthetic fuel oils fraction outlet 416 of the extraction contactor 410. A synthetic fuel oil stripping column 450 having a synthetic fuel oil fraction inlet 452, the synthetic fuel oil exit point 48 of the bitumen separation means 40 and a gaseous extractant outlet 454 is connected to the heat exchanger 440. Synthetic fuel oil is produced in the synthetic fuel oil stripping column 450 by removing substantially all traces of the extractant from the synthetic fuel oil fraction. A second extractant condenser 460 having an extractant inlet 462, an extractant outlet 464, a vacuum outlet 466 and both the cooling water input point 43 and the heated water exit point 49 of the bitumen separation means 40 is connected to the synthetic fuel oil stripping column 450 in the extractant condensor 460 both the gaseous extractant is cooled and the flow of water to be provided to the tar-sand conditioning means 10 is heated. An extractant separator 470, having two extractants inlets 472, an extractant outlet 476, and an unused water outlet 478, through which liquid extractant passes and in which a mixture of extractant and water could be separated is connected to the extractant outlets of both the extractant condensors 430 and 460. A water ring vacuum pump 480 with an integral asphaltenes extractant and water separator, having a vacuum inlet 482, an asphaltenes extractant outlet 484 and an unused water outlet 486, applies a slight vacuum to both extractant condensers 430 and 460, the synthetic crude oil stripping column 420 and the synthetic fuel oil stripping column 450. Extractant is recycled by means of an extractant recycle tank 490, having the extractant make-up input point 42 of the bitumen separation means 40, an extractant inlet 492 and an extractant outlet 494, and a pump 500.

The following description of the method of operation of this implementation of the bitumen separation means 40 is made under the assumption that the extractant preferentially removes long chain hydrocarbons from the bitumen oils. However, equivalent operation can be achieved with extractants which preferentially remove other components of the bitumen oils. Bitumen oils leaving the solvent recovery means 30 at bitumen exit point 37 flow into the bitumen separation means 40 and extraction contacter 410 at bitumen input point 41. Simultaneously extractant enters the extraction contactor 410 at the extractant inlet 412. The bitumen oils which have entered the extraction contactor 410 pass progressively from compartment to compartment in the extraction contactor 410 via its circumferential gaps, as explained in U.S. Pat. No. 4,160,718. Similarly, the extractant which has entered the extraction contactor 410 passes progressively from compartment to compartment in the extraction contactor 410 as a flow counter-current to that to the bitumen oils. Within the extraction contactor 410, the bitumen oils and the extractant form two separate phases, the lighter one in the top portion of the extraction contactor 410 and the heavier one in the lower portion with the two separate phases moving in counter-current relationship with each other. The operation of the extraction contactor 410 is so arranged that the interface between the two counter-currently flowing streams remains approximately static at or adjacent to the axis of the rotary contactor. As the material in the lower portion of the extraction contactor 410 passes through, it is continuously raised up from the bottom of the extraction contactor 410 and rained through the counter-currently flowing stream at the top of the extraction contactor 410; U.S. Pat. No. 4,160,718 in column 4 lines 48 through 55. The result produced by the combined effect of the counter-current flowing streams and the showering of the material in the lower phase through that in the upper phase is that the concentration of certain selected components in the bitumen oils entering the extraction contactor 410 at bitumen input point 41 is reduced prior to its leaving the extraction contactor 410. This reduction of the relative concentration of components in the bitumen oils is achieved by transferring selected materials from the bitumen oils to the extractant prior to the flow of that mixture from the extraction extraction contactor 410. Adjustment of the relative proportions of bitumen oils and extractant in the extraction contactor 410 and the relative rates of flow of bitumen oils and extractant through the extraction contactor 410 as well as other parameters of the contactor's operation such as the temperature of the materials flowing through it and its rate of rotation permits separation of the bitumen oils into the desired relative proportions of synthetic crude oil and synthetic fuel oil.

The flow of synthetic crude oil fraction produced by selectively reducing the long chain hydrocarbon concentration in the bitumen oils leaves the extraction contactor 410 by the synthetic crude oil fraction outlet 414. Within the extraction contactor 410 the temperature of the synthetic crude oil fraction has been raised by heat absorbed from the extractant. The heated synthetic crude oil fraction enters the synthetic crude oil stripping column 420 at the synthetic crude oil fraction inlet 422. Within the synthetic crude oil stripping column 420, the extractant flashes off of the synthetic crude oil fraction thereby yielding synthetic crude oil which leaves the synthetic crude oil stripping column 420 and the bitumen separation means 40 at synthetic crude oil exit point 47. The gaseous extractant, which flashed off the synthetic crude oil fraction in the synthetic crude oil stripping column 420, flows into the extractant condenser 430 at the extractant inlet 432 where it is cooled to the temperature at which it will return to the liquid phase. The cooled extractant leaving the extractant condenser 430 through the extractant outlet 434 condenses to the liquid phase prior to flowing into the extractant separator 470 at the extractant inlet 472. A vacuum is maintained on the extractant condenser 420 and on the synthetic crude oil stripping column 420 by the connection of the vacuum outlet 436 of the extractant condenser 430 to the vacuum inlet 482 of the water ring vacuum pump 480.

The synthetic fuel oil fraction flowing out of the extraction contactor 410 by the synthetic fuel oil fraction outlet 416 pass to a heat exchanger 440 which it enters through through the synthetic fuel oil fraction inlet 442. As it passes through the heat exchanger 440, the temperature of the synthetic fuel oil fraction is raised high enough so that after flowing out of the heat exchanger 440 by the synthetic fuel oil fraction outlet 444 and entering the synthetic fuel oil stripping column 450 by the heated synthetic fuel oil fraction inlet 452, the extractant flashes off the mixture. The removal of the extractant from this mixture yields synthetic fuel oil which flows out of the synthetic fuel oil stripping column 450 and the bitumen separation means 40 at the synthetic fuel oil exit point 48. The gaseous extractant, which flashed off of the synthetic fuel oil fraction flowing into the synthetic fuel oil stripping column 450, flows into the extractant condenser 460 at the extractant inlet 462 where it is cooled to the temperature at which it will return to the liquid phase. The cooled extractant leaving the extractant condenser 460 through the extractang outlet 464 condenses to the liquid phase prior to flowing into the extractant separator 470 at the extractant inlet 472. The synthetic fuel oil stripping column 450 and the extractant condenser 462 also operate under a vacuum provided by the connection of the vacuum outlet 462 of the extractant condenser 460 to the vacuum inlet 482 of the water ring vacuum pump 480.

The liquid extractant leaving the extractant condenser 430 by the extractant outlet 434 and also leaving the extractant condenser 460 by the extractant outlet 464 flow into the extractant separator 470 by the two extractant inlets 472. The extractant leaving the extractant separator 470 by the extractant outlet 476 is combined with the flow of extractant leaving the water ring vacuum pump 480 at the extractant outlet 485 and enters the extractant recycle tank 490 at the extractant inlet 492. Simultaneously with the inflow of extractant into the recycle tank 490 through the extractant inlet 492, extractant flows out of the extractant recycle tank 490 by the extractant outlet 494 to the extractant pump 500. Upon leaving the extractant pump 500 the extractant flows back to the extractant inlet 412 of the extractant contactor 410. All extractant lost in this process is made up by the addition of make-up extractant to that contained within the extractant recycle tank 490 through the extractant make-up input point 42 of the bitumen separation means 40.

The temperature of the gaseous extractant entering the extractant condenser 460 is significantly higher than the temperature of both the hot water through which the solvent soaked tar-sands pass in the soak/feed hopper 130 of the tar-sands conditioning means 10 and the hot water used to form the slurry in the jet mixer 140 of the tar-sands conditioning means 10. Therefore, a significant heat quantity of heat, which would otherwise have to be supplied to the water in the heat exchanger 150 of the tar-sand conditioning means 10, can be conserved by passing the water to be supplied to the tar-sands conditioning means 10 through the extractant condenser 460.

In the preferred embodiment of this invention especially adapted to extract bitumen oils and separate them into synthetic crude oil and synthetic fuel oil from tar-sand ores similar in composition to those found in Santa Rosa, N. Mex., there are only traces of water in the bitumen oils entering the extraction contactor 410. Substantially all such water is removed from the bitumen oils in the solvent recovery means 30. Therefore, there can only be insubstantial flows of water out of either or both the unused water outlet 478 of the asphaltenes extractant separator 470 and the unused water outlet 486 of the water ring vacuum pump 480. However, whatever the quantity, it is capable of recycling.

Examples of materials which can be used as the extractant are acetone, furfural, phenol, Methyl Butyl Ketone, (MBK), Methyl Ethyl Ketone (MEK) or Methyl Isobutyl Ketone (MIBK) or any such material which preferably extracts the long chain hydrocarbon components contained in the bitumen oils. The preferred solvent is Methyl Butyl Ketone (MBK).

The preferred manner of operating this implementation of the bitumen separation means 40 employing MBK as the extractant is as follows. The bitumen oils enter the extraction contactor 410 at the bitumen input point 41 of the bitumen separation means 40 at a temperature of approximately 180° F. Similtaneously the MBK flows into the extraction contactor 410 through the extractant inlet 412 at a temperature of approximately 250° F. MBK is introduced into the extraction contactor 410 at a rate that ensures that the mixture of MBK and the long chain hydrocarbons which MBK preferentially removes from the bitumen oils within the extraction contactor 410 have a higher density than the bitumen oils entering the extraction contactor 410. The mixture of MBK and long chain hydrocarbons thus obtained, therefore resides in the lower phase of the extraction contactor 410 and is continuously raised up from the bottom of the extraction contactor 410 and rained through the counter-currently flowing stream of bitumen oils at the top of the extraction contactor 410. Due to the temperature difference between bitumen oils and MBK flowing counter-currently into the extraction contactor 410, their respective specific heats and their relative mass flow rates, the temperature of the synthetic crude oil fraction flowing out of the extraction contactor 410 by the synthetic crude oil fraction outlet 414 and into the synthetic crude oil stripping column 420 through the synthetic crude oil fraction inlet 422 is approximately 220° F. At this temperature and under the influence of the vacuum maintained in the synthetic crude oil stripping column 420 by the water ring vacuum pump 480, the MBK entrained in the flow of synthetic crude oil fraction flashes off yielding synthetic crude oil. Similarly, the MBK in the flow of synthetic fuel oil fraction entering the synthetic fuel oil stripping column 450 through the bitumen plus inlet 452, after having been heated to approximately 380° F. by condensing pressurized steam flowing concurrently through the heat exchanger 440, flashes off yielding synthetic fuel oil. The MBK flowing out of the synthetic crude oil stripping column 420 and the synthetic fuel oil stripping column 450 and respectively through the extractant condensers 430 and 460 is cooled such that after flowing through the extractant separator 470, combining with the flow of MBK from water ring vacuum pump 480 and flowing both through the extractant recycle tank 490 and through the pump 500, it enters the extractant inlet 412 of the extractant contactor 410 at approximately the preferred temperature of 250° F.

A detailed implementation of solid removal means 60 of FIG. 1. is shown within the dashed line 60 of FIG. 2. The processing elements employed in this method of implementing the solid removal means 60 include a tundish having the wet solids extract input point 61 and the flocculent input point 63 of the solids removal means. In this vessel flocculant introduced through the flocculant input point is mixed with the wet solids extract. The solids removal means 60 also includes an integral vacuum belt filter unit, referred to by the general reference no. 620. The integral vacuum belt filter 620 has a flocculated wet solids extract inlet 622, the damp solids extract input point 62 of the solids removal means 60, the damp tailings exit point 67 of the solids removal means 60, a water outlet 624 and a vacuum outlet 626. The integral vacuum belt filter unit 620 consists of a porous belt filter 630 onto which both the flocculated wet solids extract and the damp solids extract are loaded for the removal of moisture and a vacuum receiver 632, which gathers the moisture being drawn from both solid extracts through the porous belt filter 630. The vacuum provided to the vacuum receiver 632 of the integral vacuum belt filter unit 620 comes from a water ring vacuum pump 640, having an integral solvent water separator. The water ring vacuum pump 640 has a vacuum inlet 642, the solvent exit point 68 of the solids extraction means 60 and a water outlet 644.

The method of operation of this implementation of the solids removal means 60 is as follows. Wet solids extract, leaving the bitumen extract removal means 20 at the wet solids extract exit point 28, enters the solids removal means 60 and the tundish 610 at the wet solids extract input point 61. Flocculent, entering solids removal means 60 and the tundish 610 through the flocculent input point 63, is mixed with the wet solids extract contained in the tundish 610. The preferred flocculants are polyelectrolyte such as those marketed under the trade name PERCOL or SUPER FLOC. Both the flocculated wet solids extract thus compounded and the damp solids extract, which leaves the bitumen extract removal means 20 by the damp solids extract exit point 29 and enters the solids removal means 60 and integral vacuum belt filter 620 at damp solids extract input point 62, are spread into the porous belt filter 630 of the integral vacuum belt filter 620. The moisture content of both these solids extracts is reduced to less than ten percent by weight of the combined action of both the vacuum of the integral vacuum belt filter 620 and the temperature of the material being processed thereon. The condensed moisture removed from these solid extracts within the integral vacuum belt filter 620, containing principally water, flow out of the integral vacuum belt filter assembly 620 through water outlet 624. Concurrent with the flow of liquid from the integral vacuum belt filter 620 through the water outlet 624 is a flow of gaseous water and solvent being evacuated from the integral vacuum belt filter 620 at vacuum outlet 626. The material remaining on the belt filter 630 of the integral vacuum belt filter assembly 620 after moisture content reduction contains primarily sands and clays with some water and traces of bitumen oils. Most of the water and substantially all of the toluene is removed by the combined action of the vacuum and the temperature of approximately 180° F., at which vacuum filtration is performed. The material remaining on the porous belt filter 630 after this processing leaves the integral vacuum belt filter 620 and the solids removal means 60 at the damp tailings exit point 67.

Mixing of the flocculant with the wet solids extract need not take place in a vessel such as the tundish 610. All that is required for proper functioning of the solids removal means 60 is that a flocculant be mixed with the wet solids extract subsequent to steam sparging in the bitumen extract separator 210 but prior to its placement on the porous belt filter 630.

The gaseous water and solvent leaving the integral vacuum belt filter 620 by the vacuum outlet 626 flows into the water ring vacuum pump 640 at the vacuum inlet 642. Within the water ring vacuum pump 640 the gases return to the liquid phase and a stream consisting essentially of liquid solvent flows out of the water ring vacuum pump 640 and the solids removal means 60 at the solvent exit point 68. Similarly, the liquid water flowing out of the integral vacuum belt filter by the water outlet 624 and the water flowing out of the water ring vacuum pump 640 by water outlet 644 are combined and flow out of the solids removal means at the water exit point 69.

A detailed implementation of the water recycle means 70 of FIG. 1. is shown within the dashed line 70 of FIG. 2. The processing elements employed in this method of implementing the water recycle means 70 include a water recycle tank 710. The water recycle tank 710 has the water input points 71 and 72, the first auxillary water input point 73 and the second auxillary water input point 74 of the water recycle means 70 and a water outlet 712. The water recycle means 70 also includes a pump having the water exit point 79 of the water recycle means 70.

These elements act together to function as the water recycle means 70 in the following manner. The recovered water flowing from the water exit point 69 of the solid removal means 60, enters the water recycle means 70 and the water recycle tank 710 at the water input point 71. Similarly, the combined flows of recovered water and heated make-up water, flowing from the water exit point 39 of the solvent recovery means 30, enters the water recycle means 70 and the water recycle tank 710 at the recycle water input point 72. In the preferred embodiment of this process for the extraction of bitumen oils from tar-sands and then separation into synthetic crude oil and synthetic fuel oil as especially adapted to process ore similar in composition to that found at Santa Rosa, N. Mex., no water flows into either the first auxillary water input point 73 or the second auxillary water input point 74. These flows of water, combined within the water recycle tank 710, leave that tank by the water outlet 712, flow through the pump 720 and out of the water recycle means 70 by the water exit point 79. Because the make-up water was preheated in the solvent recovery means 30 and because the water recovered in both the solvent recovery means 30 and the solids removal means 60 was heated prior to its separation from the other materials within those means, warm water flows through the water recycle means 70.

Upon leaving the water exit point 79 of the water recycle means 70, the warm water flows to the cooling water input point 43 of the bitumen separation means 40. Within the extractant condenser 460 of the bitumen separation means 40, this flow of water is heated sufficiently such that during normal operation no additional heat need be provided to this water in the heat exchanger 160 of the tar-sands conditioning means 10. After being so heated, this water flows out of the bitumen separation means 40 at the heated water exit point 49 and flows to the water input point 13 of the tar-sands conditioning means 10. The heat exchanger 160 of the tar-sands conditioning means 10 is normally used to heat the water used in the tar-sands conditioning means 10 only during start up of the process.

A detailed implementation of the solvent recycle means 80 of FIG. 1. is shown within the dashed line 80 of FIG. 2. The processing elements employed in this method of implementing the solvent recycle means 80 includes a solvent recycle tank 810. The solvent recycle tank 810 has the recycle solvent input points 81 and 82 and the auxillary solvent input point 83 of the solvent recycle means 80 and a solvent outlet 812. The solvent recycle means 80 also includes a pump 820 which provides solvent to both the solvent exit point 88 and the auxillary solvent exit point 89 of the solvent recycle means 80.

These elements act together to function as the solvent recycle means 80, in a manner similar to that of the water recycle means 70, as follows. Solvent leaving the solvent recovery means 30 at the solvent exit point 38 flows into the solvent recycle means 80 and the solvent recycle tank 810 at the solvent input point 81. Similarly solvent flowing out of the solvent exit point 68 of the solids removal means 60 enters the solvent recycle means 80 and the solent recycle tank 810 at the recycle solvent input point 82. In the preferred embodiment of this process for the extraction of bitumen oils from tar-sands and their separation into synthetic fuel oil and synthetic crude oil especially adapted to process ore similar in composition to that found at Santa Rosa, N. Mex., no solvent flows in the auxillary solvent input point 83. These flows of solvent are combined within the solvent recycle tank 810 and leave that tank at the solvent outlet 812 and enter the pump 820. This flow then leaves the solvent recycle means 80 and the pump 820 at the solvent exit point 89. Because the solvent recovered in both the solvent recovery means 30 and the solids removal means 60 was heated prior to separation from other materials within those means, warm solvent, approximately 158° F. if the solvent used is toluene, flows through the solvent recovery means 80.

The objective of this invention is that there be no mechanical pumping of slurries is achieved by this method for the extraction of bitumen oils from tar-sands by the combined effects of two features of the preferred embodiment. Mechanical pumping of slurries is first avoided by constructing the pipe 150 such that its terminal end, which is the slurry exit point 19 of the tar-sands conditioning means 10, is also the slurry input point 21 of the bitumen extract separator 210 of the bitumen extract removal means 20. Thus, the flow of hot water injected into the jet mixer 140 at the hot water inlet 144 hydraulically pumps the slurry through the pipe 150 and into the extract separator 210. The other technique by which the pumping of slurries is avoided is by arranging the bitumen extract separator 210 such that gravity will cause the wet solids extract to fall out the wet solids extract exit point 28 into the tundish 610 of the solids removal means 60 and, after having been treated with flocculant there, fail further onto the integral vacuum belt filter 620.

The object of this invention is that the bitumen oil extract contain essentially no free sulphur is achieved by the preferred embodiment especially adapted for extracting bitumen oils from tar-sands similar in composition to those found at Santa Rosa, N. Mex., because the free sulphur which such ores contain is essentially insoluble in toluene. Since the bitumen extract flowing out of the bitumen extract separator 210 of the bitumen extract removal means 20 contains principally those components of the tar-sand ore which are soluble in toluene, that flow contains little or no free sulphur. Whatever free sulphur is contained in the ore settles to the bottom of the bitumen extract separator 210 to leave that vessel at the wet solids extract exit point 28. Thus, the sulphur contained in the tar-sand ore ultimately leaves the process in the damp tailings not in the bitumen oils extracted from the tar-sands. Thus, since the bitumen extract contain essentially no free sulphur and further, since tar-sands similar in composition to these found at Santa Rosa, N. Mex., contain essentially no organic sulphur, the synthetic crude oil and synthetic fuel oil produced by this process are essentially sulphur free. Therefore, burning either the synthetic fuel oil or synthetic crude oil produced by this process in order to obtain the steam required to operate the process results in low sulphur emissions in the combustion products.

The objective of this invention is that there be low heat loss which is achieved by the cumulative effect of: (a) Applying warm solvent, obtained principally from the bitumen extract in the solvent recovery means 30, to soak the tar-sands in the tar-sands conditioning means 10; (b) Pre-heating the make-up water in the solvent recovery means 10; (c) Recovering and recycling as much warm water as practical from both the bitumen extract entering the solvent recovery means 30 and the wet solids extract entering the solids removal means 60; and (d) Passing the entire flow of water to be used in the tar-sand conditioning means 10 through the bitumen separation means wherein it acquires substantially all the heat required for proper operation of the tar-sand conditioning means 10.

The feature of this invention which permits it to minimize heat loss arises from the facts that a significant fraction of all the heat supplied to the process is retained within the process either as a warm temperature in the recycled fluids, both solvent and water, or as cooling loads in both the solvent-water condenser 330 of the solvent recycle means 30 and the asphaltenes extractant condenser 460 of the bitumen separation means 40. Thus, heat, in addition to both the liquid solvent and water, is conserved by recovering and reusing both those materials. Additional heat is conserved by employing the process water as coolant in both the solvent-water condenser 330 and the asphaltenes extractant condenser 460 prior to using it in the tar-sands conditioning means 10.

The balance between the quantity of heat obtained both by recovering and reusing the solvent and the water and by using the process water as a coolant and the quantity of heat which must be applied to the tar-sands by the hot water in the tar-sands conditioning means 10 is maintained by adjusting the strength of the vacuum applied respectively to both the solvent-water condenser 330 by the water ring vacuum pump 350 and the asphaltenes extractant condenser 460 by the water ring vacuum pump 480. As the strength of the vacuum applied to those condensers is increased, the temperature of the gases flowing into them is reduced. Therefore, the quantity of heat supplied both to the coolant flowing through these condensers and as well as that available in the liquids condensed from the gases flowing through them is reduced as the strength of the vacuum applied to them is increased. Thus, the quantity of heat provided to the tar-sands conditioning means 10 is reduced by increasing the strength of either or both of vacuums applied to the solvent-water condenser 330 and the extractant condenser 460. Correspondingly, that quantity of heat is increased by reducing the strength of either or both the vacuums applied to those two condensers.

A number of alternative implementations of the bitumen extract removal means 20 are possible. This multitude of possible alternatives occurs because of variations in solids composition among various tar-sands deposits within the world and because of variations in the fraction of solids permitted either in the bitumen oils leaving the solvent recovery means 30 or in the synthetic fuel oil leaving the bitumen separation means 40. Thus, depending upon the solids composition of the tar-sands being processed and the fraction of solids permitted in the bitumen oils, an adequate bitumen extract removal means 20 could be implemented without the pump 230 and the centrifuge 240. In such a case, the bitumen extract outlet 224 of the bitumen extract hold-/feed tank 220 would be connected directly to the inlet of the pump 250 and there would be no damp solids extract leaving the bitumen extract removal means 20 through the damp solids exit point 29. Clay removal means such as electrostatic precipitators or a physical separation using water in a gently agitated settling vessel or a contactor fed with hot water and extract concurrently passed through may be used as alternatives to the solid bowl centrifuge 240. Alternatively, tar-sand deposits having a higher clay content than that of ores similar in composition to that found at Santa Rosa, N. Mex., or clay contamination with associated bitumen oils may require that the bitumen extract removal means 20 have processing elements in addition to those shown in the preferred embodiment of FIG. 2 if a sufficiently stringent solids content specification on the bitumen oils or the synthetic fuel oil is to be satisfied.

A detailed implementation of the bitumen extract removal means 20 of FIG. 1 especially adapted to process tar-sand ores having extreme cases of clay contamination with associated bitumen oil is shown within the dashed line 20 of FIG. 3. The processing elements employed in this especially adapted method of implementing the bitumen extract removal means 20, in addition to those elements shown in the detailed implementation of FIG. 2, include a middlings stream contactor 910. The middlings stream contactor 910 has a middlings stream inlet 912, a contacted middlings stream outlet 914, a solvent inlet 916, and a solvent outlet 918. Within the middlings stream contactor 910 a middlings stream containing a mixture of clay, bitumen oils, solvent and water is contacted with a counter-current flow of solvent.

This especially adapted bitumen extract removal means 20 also includes a solvent stripper 920, having a contacted middlings stream inlet 922, a solvent-water outlet 924, a steam sparging means 927 located near the base of the solvent stripper 920 and a stripped middlings stream outlet 928. Solvent entrained in the contacted middlings stream is removed in the solvent stripper 920 by the action of the steam sparging means 927. Connected to the stripped middlings stream outlet 928 is a thickener 930. The thickner 930 has a stripped middlings stream inlet 932, a flocculant inlet 934, a clarified overflow water outlet 937 and a thickened middlings stream outlet 938. Within the thickner 930 a portion of the water in the stripped middlings stream is clarified by treating that stream with a flocculant, thereby precipitating the clays which it contains. A pump 940 is connected to the thickened middlings stream outlet 938 and pumps the thickened middlings stream to a solid bowl centrifuge 950. The solid bowl centrifuge 950 has a thickened middlings stream inlet 952, a carified water outlet 954, and a damp solids extract outlet 956. The solids content of the clarified water is further reduced in the solid bowl centrifuge 950.

The method of processing tar-sand ores having an extreme case of clay contamination with associated bitumen is as follows. A middlings stream containing a mixture of clay with associated bitumen oils, solvent and water is drawn out of the middlings stream outlet 216 located near the middle of the bitumen extract separator 210. This middlings stream passes into the middlings stream contactor 910 through the middlings stream inlet 912. In the preferred embodiment of this method of implementing a bitumen extract removal means 20 especially adapted to process tar-sand ores having an extreme case of clay contamination with associated bitumen, the middlings stream contactor 910 is of the raining-bucket type similar in structure and function to the asphaltenes extraction contactor 410 of the bitumen separation means 40. Concurrent with the middlings stream flow through the middling stream inlet 912 of the middlings stream contactor 910, a counter-current flow of solvent is introduced through the solvent inlet 916 of the middlings stream contactor 910. The flow of solvent entering the middlings stream contactor 910 through the solvent inlet 916 is obtained from the auxillary solvent exit point 89 of the solvent recycle means 80. Within the middlings stream contactor 910, the solvent and the middlings stream form two separate phases, with the lower one being continuously raised up and showered down through the upper one as the middlings stream and the solvent flow counter-currently through the contactor 910. The result produced by the counter-current flows of the middlings stream and the solvent and the constant raining of one flow through the other is that the bitumen oils content of the middlings stream is reduced. The bitumen oils thus extracted from the clay leaves the middlings stream contactor 910 in the flow of solvent passing through the solvent outlet 918, which then returns to the auxillary solvent input point 83 of the solvent recycle means 80. The middlings stream in which the bitumen oils content has been reduced flows out of the middlings stream contactor 910 through the contacted middlings stream outlet 914.

Upon leaving the middlings stream contactor 910 through the contacted middlings stream outlet 914, the middlings stream in which the bitumen oils content has been reduced flows into the solvent stripper 920 through contacted middlings stream inlet 922. The solvent stripper 920 is operated under a vacuum provided by the connection of the solvent-water outlet 924 of the solvent stripper 920 to the auxillary solvent-water input point 33 of the solvent removal means 30 and its solvent-water condenser 330. Within the solvent stripper 920, the contacted middlings stream is sparged with steam, raising the temperature of the contents of the solvent stripper 920 to that at which the solvent entrained in the contacted middlings stream will enter the gaseous phase under the influence of the vacuum applied through the solvent-water outlet 924. Thus substantially all of the solvent entrained in the contacted middlings stream will be driven off by the combined action of the steam sparging and the reduced pressure in the solvent stripper 920. The solvent thus stripped from the middlings stream flows out of the solvent stripper 920 through the solvent-water outlet 924, leaving the bitumen extract removal means 20 and flowing into the auxillary solvent-water input point 33 of the solvent removal means 30 and its solvent water condenser 330. The stripped middlings stream thus produced flows out of the solvent stripper 920 by the stripped middlings stream outlet 928.

Upon leaving the solvent stripper 920 through the stripped middlings stream outlet 928, the stripped middlings stream passes into the thickener 930 through the stripped middlings stream inlet 932. A flocculant is added to the stripped middlings stream in the thickener 930, thereby thickening the clays and creating a flow of clarified water which overflows out of the thickener 930 through the clarified overflow water outlet 936. The thickened clays then flow out of the thickened middlings stream outlet 938, through the pump 940 and pass into the solid bowl centrifuge 950 through the thickened middlings stream inlet 952. Within the solid bowl centrifuge 950, the solids content of the water contained in the thickened middlings stream is further reduced, and the clarified water thus obtained flows out of the solid bowl centrifuge 950 through the clarified water outlet 954. The water flowing both out of the clarified overflow water outlet 937 of the thickener 930 and the clarified water flowing out of the solid bowl centrifuge 950 through the clarified water outlet 954 are combined and leave the bitumen extract removal means 20 flowing to the first auxillary water input point 83 of the water recycle means 70. The damp solids extract, produced in the solid bowl centrifuge 950 by clarifying the water, leaves that vessel by the damp solids extract outlet 956. The damp solids extract leaving the solid bowl centrifuge 950 by the damp solids extract outlet 956 and the damp solids extract leaving the solid bowl centrifuge 240 by the damp solids extract outlet 246 are combined and leave the bitumen extract removal means 20 by the damp solids extract point 29.

If toluene is the solvent used to soak tar-sand ore in the soak/feed hopper 130 of the tar-sand conditioning means 10, then the middlings stream will form the lower phase in the contactor 910 and will be continuously raised up and rained through the toluene, which will form the upper phase. Within the solvent stripper 920, the azeotrope of toluene and water will be driven off the contacted middlings stream by raising the temperature of the contents of the solvent stripper 920 to approximately 180° F. The flocculant material added to the stripped middlings stream in the thickener 930 is identical to that applied to the wet solids extract in the tundish 610 of the solids removal means 60.

If the clays being removed from a middlings stream do not contain associated bitumen, then the process just described can be simplified to processing such a middlings stream flow. A method for processing a middlings stream without associated bitumen omits the use of both the middlings stream contactor 920, with its associated flows of solvent coming from and returning to the solvent recycle means 80, and the solvent stripper 920, with the connection between its solvent-water outlet 924 to the auxillary solvent-water input point 33 of the solvent recovery means 30 and the consequent application of vacuum to the solvent water stripper 920 and flow of gaseous solvent and water into the solvent recovery means 30. In processing a middlings stream without associated bitumen, the middlings stream drawn out of the middlings stream outlet 216 of the bitumen extract separator 210 flows directly into the stripped middlings stream inlet 932 of the thickener 930. The subsequent processing of such a flow is identical to that just described for processing a middlings stream with associated bitumen. As before, such processing produces a combined flow of water from the clarified overflow water outlet 936 of the thickener 930 and the clarified water outlet 954 of the solid bowl centrifuge 950. This combined flow of water leaves the bitumen extract removal means 20 and, as before, flows to the first auxillary water input point 73 of the water recycle means 70. As before, the damp solids extract produced in the solid bowl centrifuge 950 leaves that vessel by the damp solids extract 956 and is combined with the damp solids extract leaving the solid bowl centrifuge 240 by the damp solid extract outlet 246. As before, the combined flow of damp solids extract thus obtained leaves the bitumen extract removal means 20 by the damp solids extract point 29.

Shown in FIG. 4 is a modification of the detailed diagram of FIG. 2 especially adapted to recover and recycle water from the bitumen separation means 40. If this process for the extraction of bitumen oils from tar-sands and the separation of those bitumen oils into synthetic fuel and synthetic fuel oil is operated in a manner other than that of the preferred embodiment, i.e. processing tar-sand ores similar in composition to those extracted at Santa Rosa, N. Mex., with toluene as the bitumen oils extraction solvent and MBK as the asphaltenes extractant, it is possible that a significant quantity of water could flow out of the unused water outlet 478 of the extractant separator 470 and the unused water outlet 486 of the water ring vacuum pump 480 of the bitumen separation means 40. In such a case the water recovery and recycling objective of this method for the extraction of bitumen oils from tar-sands and their separation into synthetic crude oil and synthetic fuel oil can be maintained by combining those two flows of water and returning them to the second auxillary water input point 74 of the water recycling means 70 as shown in FIG. 4.

Although the present invention has been described in terms of the presently preferred embodiments, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

I claim:

1. A method for extracting bitumen oils from tar-sands comprising the steps of:

(a) crushing the tar-sands to yield particles of a predetermined size;

(b) soaking the tar-sands in an organic solvent to soften the oil layer surrounding the tar-sand particles;

(c) mixing the solvent soaked tar-sands with hot water while excluding substantially all air therefrom such that a slurry, containing sand, bitumen oils, solvent, and hot water, is formed;

(d) dislodging the bitumen oils, solvent and water from the solid and dry particles in the slurry through jet mixing and pumping means while continuing to exclude air;

(e) separting said slurry into at least a first and second stream, with said first stream being a bitumen extract containing bitumen oils, solvent and water with traces of solids, and said second stream being a wet solids extract containing sand, clay and water with traces of bituminous oils and solvent;

(f) separating said first bitumen extract into a component of bitumen oils and a component of solvent and water mixture;

(g) separating said wet solids extract into a component of damp tailings and a component of water and solvent; and (h) separating said component of solvent and water mixture into a solvent component and a water component;

(i) separating said bitumen oils into synthetic fuel oil and synthetic crude oil.

2. A method as recited in claim 1 wherein the solvent is toluene.

3. A method as recited in claim 1 wherein (a) the temperature of the hot water mixed with the tar-sands so as to form the slurry is between approximately 195° F. and approximately 205° F.; and (b) the temperature of said slurry is between approximately 175° F. and approximately 185° F.

4. A method as recited in claim 1 wherein the quantity of solvent used to soak the tar-sands produces a bitumen extract having a specific gravity less than 0.9.

5. A method as recited in claim 1 wherein said organic solvent is a component of the bitumen oils extracted from the tar-sands.

6. A method as recited in claim 1 wherein the jet mixing and pumping means include pumping the mixture through a pipe having a cross-sectional area such that turbulent flow exists, said pipe having a length predetermined such that upon exit from said pipe the bitumen oils of said slurry will have substantially separated from said sand and clay in said tar-sands.

7. A method as recited in claim 1 wherein said slurry is separated into streams by density separation means whereby the heavier solid components form a lower layer and the higher liquid components form an upper layer.

8. A method as recited in claim 7 wherein said slurry is stream sparged, driving out solvent and solvent-soluble bitumen oils entrained in said solids.

9. A method as recited in claim 8 wherein said slurry is separated into three streams, the first and lightest stream being a bitumen extract containing bitumen oils, solvent and water with traces of solids; the second stream being a wet solids extract containing bitumen sand, clay and water with traces of bitumen oils and solvent; and the third stream being a damp solids extract containing sand, clay, said third stream being the heaviest of said three streams and containing lesser quantity of water with traces of bitumen oils and solvent.

10. A method as recited in claim 1 wherein said bitumen extract is separated into a component of bitumen oils and a component of solvent and water mixture by distilling said bitumen extract under the influence of a vacuum whereby components of water and solvent flash off the heavier bitumen oils component leaving substantially pure bitumen oils.

11. A method according to claim 1 wherein said mixture of water and solvent is separated into a component of water and a component of solvent by gravity separation means; and said solvent component is collected and reused to again soak said tar-sands, and said water component is reheated to again soak said solvent-soaked tar-sands.

12. The method as recited in claim 1 wherein said wet solids extract is separated into a damp tailings component, a water component and a solvent component by:

(a) mixing a flocculant with said wet solids extract;

(b) spreading said wet solids extract onto a porous filter belt of a vacuum belt filter;

(c) applying a vacuum to said wet solids extract while it is spread on the porous filter belt; and (d) collecting the resultant water and solvent mixture and separating said mixture into a water component and a solvent component by gravity separation means.

13. A method as recited in claim 12 wherein said flocculant is a polyelectrolyte.

14. A method according to claim 1 wherein the bitumen oils are separated into synthetic fuel oil and synthetic crude oil by:

(a) pumping the bitumen oils counter to an approximately equal flow of an organic extractant using rotary contactor means, said extractant preferentially dissolves and extracts the long chain hydrocarbons contained in the bitumen oils;

(b) mixing and dispersing said bitumen oils and said extractant to cause substantially all long chain hydrocarbons plus extractant to form a lower layer of synthetic fuel oil, and the remaining lighter components plus extractant to form an upper layer of synthetic crude oil;

(c) drawing off the lighter mixture of synthetic crude oil plus extractant into a vacuum stripping column where substantially all extractant is removed to yield synthetic crude oil;

(d) drawing off the heavier mixture of synthetic fuel oil plus extractant into a vacuum stripping column where substantially all extractant is removed to yield synthetic fuel oil; and (e) collecting and reusing said extractant removed from said synthetic crude oil fraction and from said synthetic fuel oil fraction.

15. A method as recited in claim 14 wherein said extractant is methyl butyl ketone.

16. A method for extracting bitumen oils from tar-sands in steps comprising:

(a) crushing the tar-sands to a predetermined maximum particle size;

(b) mixing the crushed tar-sands with hot water and an organic solvent to form a slurry, while excluding substantially all air therefrom;

(c) dislodging the bitumen oils, solvent and water from the solids in the slurry through jet mixing and pumping means;

(d) separating the slurry into streams based on density and boiling point whereby a stream of bitumen oils is obtained, a stream of water and solvent mixture is obtained, and a solids stream is obtained;

(e) separating said bitumen oils stream into synthetic fuel oil and synthetic crude oil; and (f) separating said water and solvent stream into a water component and a solvent component.

17. A method according to claim 16 wherein said solvent is a component of the bitumen oils.

18. A method according to claim 16 wherein said bitumen oils are separated into synthetic fuel oil and synthetic crude oil by pumping said bitumen oils counter to an approximately equal volume of an organic extractant using rotary contactor means whereby said synthetic fuel oil forms a lower layer and said synthetic crude oil forms an upper layer; and drawing off each of said layers into a vacuum stripping column where substantially all extractant is removed, and collecting and recycling said extractant.

19. A method according to claim 16 wherein said water component is separated from said solvent component by vacuum distillation means, and said water and said solvent components are recycled.

* * * * *